US005190476A

United States Patent [19]

Chaillot

[11] Patent Number: 5,190,476

[45] Date of Patent: Mar. 2, 1993

[54] PLUGGABLE ELECTRICAL CONNECTION BLOCK AND CONNECTOR INCORPORATING SUCH A BLOCK

[75] Inventor: Georges Chaillot, Lormaye, France

[73] Assignee: Francelco, Suresnes, France

[21] Appl. No.: 835,399

[22] Filed: Feb. 14, 1992

[30] Foreign Application Priority Data

Feb. 15, 1991 [FR] France ..... 91 01820

[51] Int. Cl.[5] ..... H01R 13/40

[52] U.S. Cl. ..... 439/595; 439/594; 439/680; 439/701; 439/752

[58] Field of Search ..... 439/594, 595, 597-601, 439/603, 680, 701, 712, 752

[56] References Cited

U.S. PATENT DOCUMENTS

| | | | |
|---|---|---|---|
| 4,596,436 | 6/1986 | Kraemer . | |
| 4,682,839 | 7/1987 | Bryce | 439/701 |
| 4,781,619 | 11/1988 | Ikeda . | |
| 4,787,864 | 11/1988 | Hunt, III et al. | 439/595 |
| 4,900,274 | 2/1990 | Dorleans et al. | 439/680 |
| 4,936,798 | 6/1990 | Hass et al. | 439/752 |
| 4,944,688 | 7/1990 | Lundergan | 439/752 |
| 4,997,386 | 3/1991 | Kawachi et al. | 439/701 |
| 5,026,304 | 6/1991 | Furrow | 439/603 |
| 5,057,040 | 10/1991 | Kodama et al. | 439/594 |
| 5,071,374 | 12/1991 | Plocek et al. | 439/595 |

FOREIGN PATENT DOCUMENTS

| | | |
|---|---|---|
| 2133228 | 7/1984 | United Kingdom . |
| 0242318 | 10/1987 | United Kingdom . |

*Primary Examiner*—Paula A. Bradley

*Attorney, Agent, or Firm*—Pollock, Vande Sande & Priddy

[57] ABSTRACT

A pluggable electrical connection block comprises a rectangular housing having parallel sideways therein and a plurality of flat slabs of elongated cross-section made of insulating material, each in one slideway. Each slab is formed with a single row of parallel passages for receiving respective contact terminals and has a major face cut out to constitute individual resilient retaining detents for engaging holes in the terminals. The housing and slabs have a slidable keying connector. The projections defining the slideways are formed throughout the entire depth of the housing so as to guide each slab from the moment it is inserted in the housing. The detents are placed short of the front end of the respective slab. The housing has a step formed internally on one of the major sides for coming into abutment against any raised detent.

10 Claims, 2 Drawing Sheets

FIG.1.
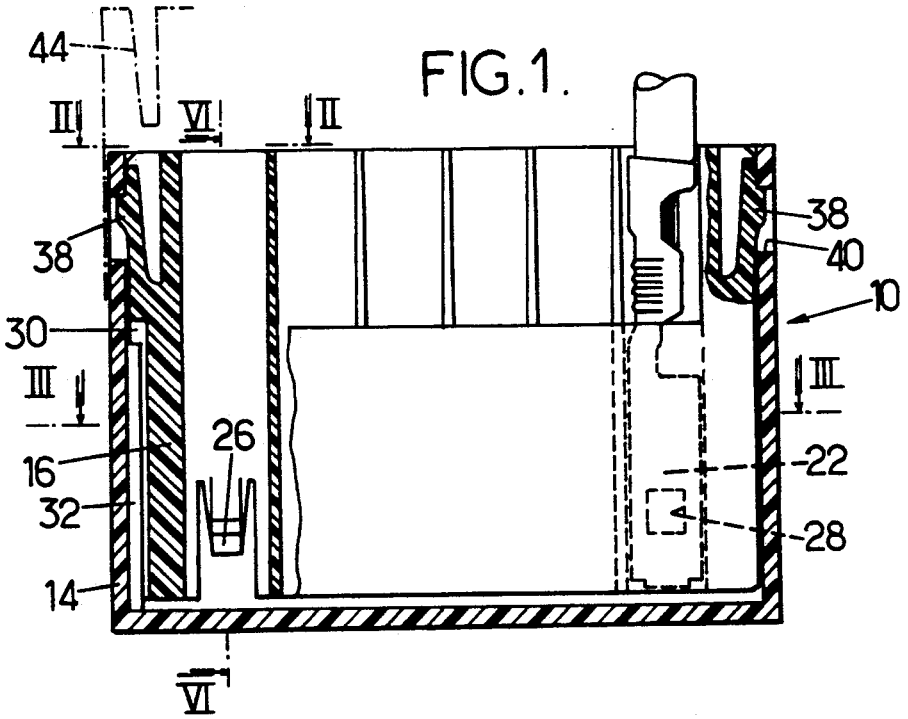
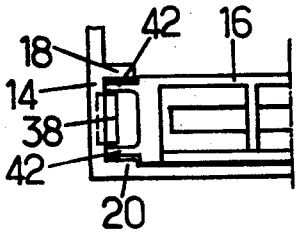
FIG.2.
FIG.3.
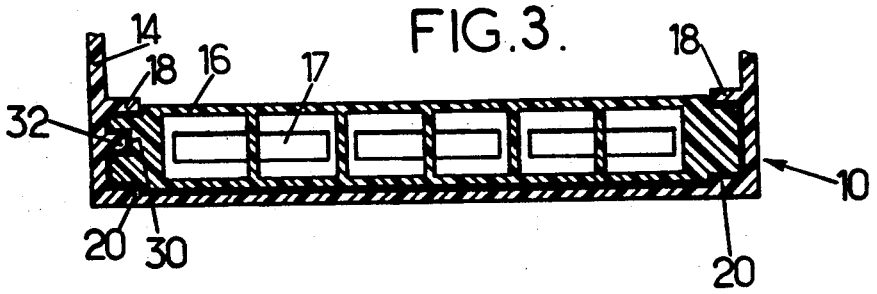
FIG.5.
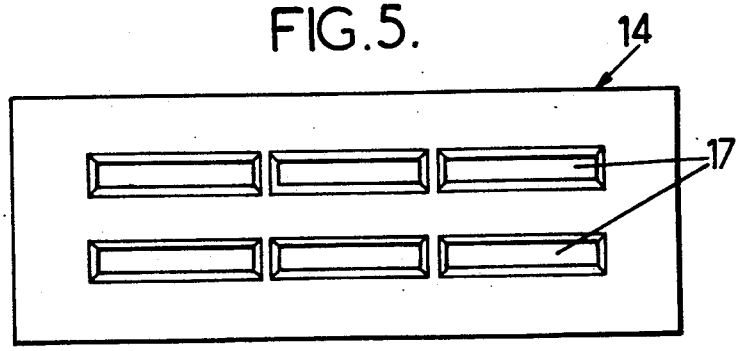

PLUGGABLE ELECTRICAL CONNECTION BLOCK AND CONNECTOR INCORPORATING SUCH A BLOCK

BACKGROUND OF THE DISCLOSURE

The invention relates to electrical connectors having two connection blocks that are pluggable into each other, and it relates more particularly to a connection block for such a connector which is of the so-called "modular" type. The connector comprises a rectangular housing with two opposite faces having longitudinal projections that delimit parallel sideways and flat slabs of insulating material, each slab occupying one of said slideways and including a single row of parallel passages for receiving contact terminals, and having a large face cut out in a front portion thereof to constitute individual retaining detents for the terminals that engage in holes in the terminals, the housing and each slab including cooperating keying means that allow a slab to be fully inserted in one orientation only.

A block of the above-defined kind can easily be designed to incorporate slabs giving contact terminal distribution pitches that vary from one slab to another (but naturally are equal for the two cooperating slabs of the two blocks of a same connector). It is also possible to omit some of the slabs in applications where the corresponding terminals are not required. All of these features make such a connector particularly advantageous in numerous fields, including the automotive industry and workshops using electronically controlled machine tools and/or robots.

Existing connection blocks of the above-defined type have some drawbacks. In particular, it happens that slabs are forced into position even when one of the terminals carried thereby has not been fully pushed home and has not snapped into place, either because forward movement of the slab causes the detent to be pushed back inwardly, or else because the detent is folded to such an extent that it breaks. In either case the terminal is no longer retained once the slab has been inserted.

SUMMARY OF THE INVENTION

An object of the invention is, in particular, to avoid this risk. To this end it provides a connection block of the above type, characterized in that the projections occupy the entire depth of the housing so as to guide each slab from the moment it is inserted in the housing, in that the detents are set back from the front of the slab, and in that the housing includes a step on one of its large sides that comes into abutment against any detent of the slab that is lifted because a terminal of the slab is not fully pushed home, thereby limiting the bending deformation of a detent.

By guiding the slab accurately from the moment it starts to be inserted, it is guaranteed that any detent raised by a terminal comes into abutment against the step and slides thereon until it abuts the shoulder limiting it. The operator is then warned with certainty and is led to check the terminals.

It is also possible to form an abutment step on the back of each slab, on the major face thereof opposite to the major face in which the detents are cut out, thereby causing each slab to protect the following slab against a failure to snap in place.

It may also be observed that once all of the slabs are in place (even if the first slideways only are occupied), then all of the detents are retained and are prevented from rising.

The invention is particularly advantageous in connectors whose male terminals are blades whose width extends in the row direction and in which the female terminals are of the cage type. Under such circumstances, the housing of each block advantageously has side walls interconnected by a bottom which is formed with rows of slots each corresponding to a location for a slab; by making the slots longer than the spacing between two passages, it is possible to place slabs in the housing having any one of several different distribution spaces for use with terminals of different sizes in the row direction: for example, female terminals can be used that are 2.8 mm wide and that are 1.5 mm wide, respectively distributed at spacings of 5 mm and 3.33 mm (i.e. so that three closely spaced terminals occupy the same length as two large spacing terminals).

The slabs must be held in place. This can be achieved by external means. However, in an advantageous embodiment, each of the small faces of each slab carries a resilient retaining finger having at the rear thereof a catch for engaging in an opening in the housing, the finger being straddled by two rigid wings. The wings prevent jamming of the finger, e.g. by a wire engaged between the finger and the body of the slab.

To avoid the risk of slabs for male terminals (blades) being installed in a housing for receiving slabs of female terminals (cages), the keying means may include on a single one of the small faces of each slab, a groove or a rib placed on one side of the mid plane for one type of slab and on the other side for the other type; a single one of the faces of the housing includes grooves or ribs in a corresponding location. The keying means thus perform two functions.

The invention will be better understood from the following description of particular embodiments of the invention given by way of non-limiting example. The description relates to the accompanying drawings:

BRIEF DESCRIPTION OF THE HOUSING

FIG. 1 shows a male connection block in accordance with a first embodiment of the invention, shown partially in section along a plane passing through an insulating slab containing a single female terminal;

FIGS. 2 and 3 are views along lines II—II and III—III of FIG. 1;

FIG. 5 is a bottom view of the housing of the block of FIG. 1;

DETAILED DESCRIPTION

Figure 4:
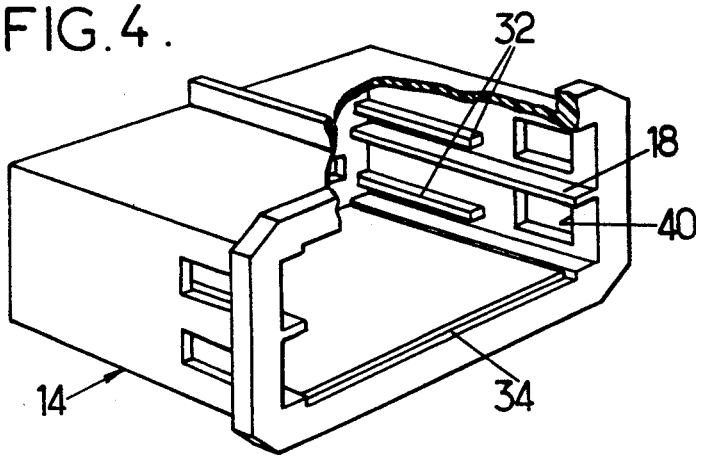
FIG. 4 is a perspective view of the housing of the block of FIG. 1, not drawn to scale.

The male connection block 10 shown in FIGS. 1 to 3 is intended to receive cage type female terminals and to be plugged into a mating female connection block 12 (FIG. 6) fitted with male terminals comprising contact tongues or blades. Such a block is usable, in particular, on motor vehicles.

The block 10 comprises a housing 14 for receiving one or two slabs 16 (the housing possibly being designed to receive a larger number of slabs). The housing 14 and the slabs 16 may be made of a polymerised synthetic material containing fillers.

The housing 14 is rectangular in cross-section and has sides that are interconnected by an end wall which is formed with rows of parallel slots 17. It includes means defining slideways for guiding slabs 16 from the moment they are inserted. For a two-slab housing, these means comprise a single pair of guide projections 18 formed along two opposite sides of the housing, together with pairs of guide steps 20 situated where the large sides meet the small sides of the housing, all of constant cross-section corresponding to the cross-section of grooves formed in the edges of the slabs.

Figure 9:
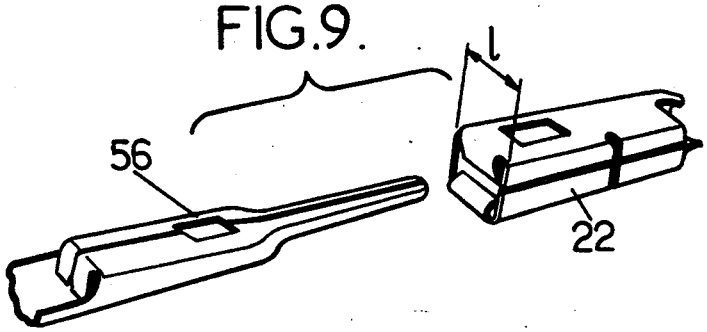
FIG. 9 is a diagrammatic perpective view showing terminals that are usable in connectors of the kind shown in FIGS. 6, 7 and 8.

In each of the slabs, of elongate rectangular cross-section and of a thickness such that the slabs leave only a small gap therebetween and with the housing, there is formed a row of a plurality of rectangular section passages each intended to receive a terminal 22 (FIGS. 1 and 9). The fully engaged position of each terminal is determined by its coming into abutment against an abutment rim 24 provided on the slabs.

One of the major faces of each slab is cut out to form resilient detents 26 whose catches are designed to engage into one of two abutting holes 28 provided in each terminal, on two opposite sides. The detents 26 terminate short from the front end of the slab and from the abutment rim 24. The detent extends beyond the catch so that its bending causes its end to move further than the associated displacement of the catch, this constituting a factor that facilitates detecting non-engagement.

In the front portion of a single one of the small faces of each slab 16, a keying groove 30 is provided which is offset from the mid-plane of the slab and intended to slide over a keying rib 32 provided on only one side of the housing 14. By using opposite offsets for slabs of male blocks and female blocks, not only a reversed insertion of the slabs in a housing is avoided, but also any error as to the housing is avoided.

Figure 6:
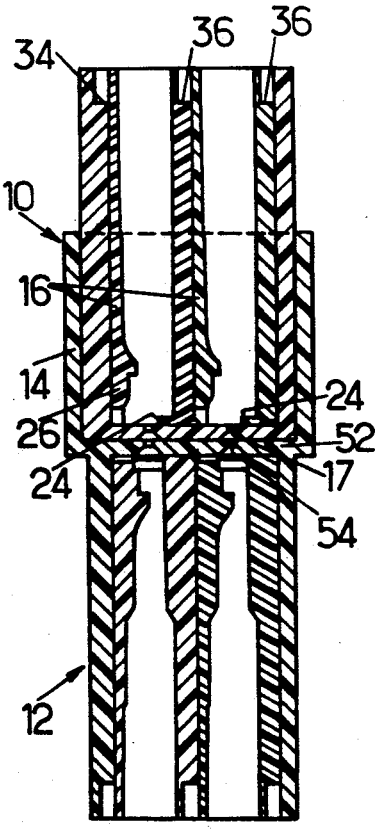
FIG. 6 is a sectional view along line VI—VI through the block of FIG. 1 and the mating block.

If a terminal 22 is not completely pushed home, it is not locked in place. The corresponding resilient detent 26 therefore projects laterally. To ensure that it is then impossible to put the slab into place, a step 34 is cut into that one of the major sides of the housing which faces the detents of the first slab (FIGS. 4 and 6). Thus, any detent raised by any incompletely inserted terminal comes into abutment against the shoulder of the step and jams against the shoulder of the step. This abutment is certain to occur because the slab is guided from the beginning of its insertion while the end of the detent 26 is offset back.

The housing is involved for preventing insertion of the first slab only in the event of one of the detents thereof remains projecting outwards. Means are advantageously provided to prevent insertion of the second slab likewise and possibly of further slabs. In the example shown in FIG. 6, these means are constituted by a step 36 on each of the slabs.

In the block shown by way of example in FIGS. 1 to 6, the slabs are held in place individually. To do this, each of the small faces of each slab is cut out to constitute a resilient finger 38 having a locking catch for engaging in a corresponding opening 40 in the housing 14. In order to avoid any risk of a finger 38 jamming in projecting position, e.g. by a wire becoming inserted between the Figure and the body of the slab, each finger 38 is advantageously disposed between two side protective wings 42 (FIG. 2). The means enabling the male block to be fixed to the female block may include extensions 44 that engage between the fingers 38 and the bodies of the slabs, thereby preventing the slabs from being withdrawn.

Figure 7:
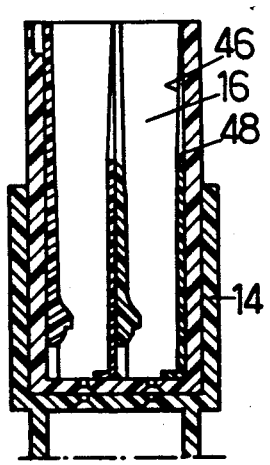
FIGS. 7 and 8 are similar to a fraction of FIG. 6 and show other embodiments.
Figure 8:
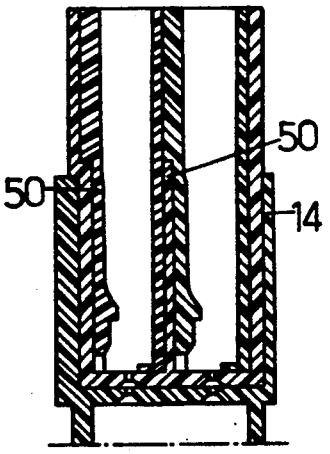

FIGS. 7 and 8 show other embodiments in which the steps 36 for preventing insertion of slabs other than the first, should a detent remain raised, are replaced by other means.

In FIG. 7, the partitions of each slab separating the passages therein are provided with respective sloping edges 46, and that one of the major faces of the slab which does not carry detents terminates about two thirds of the way along the slab so as to constitute a support shoulder 48.

In the case shown in FIG. 8, the housing 14 has short walls 50 whose ends constitute abutments.

A connector may be constituted by a male block of any one of the types described above and by a female block 12 of the type shown in FIG. 6. This female block also includes sides and an end wall 52 which in this case is at a distance from the entrance of the block. The slots 17 formed in the bottom wall of the housing 14 and the slots 54 in the bottom wall 52 are placed so that they coincide. They are wide enough to be able to pass the tongues of male terminals 56 retained in the slabs of the female block 12 and they are long enough to occupy the major portion of the length of the row of slots. FIGS. 3 and 5 show, by way of example, rows of three slots 17, whereas the housing 14 is capable of receiving slabs having six passages. This disposition of slots makes it possible to place any one of several types of slab having passages of different transverse dimensions and having different numbers of passages in a given housing. Thus, depending on the electric current to be passed, slabs can be provided for terminals having a contact zone of width 1 that varies from one slab to another, while they all have the same thickness.

To increase the strength of the blades of the male terminals 56, these terminals may be constituted by folding metal sheet to double the thickness of the blade and then by cutting out the ends of the blades.

I claim:

1. A pluggable electrical connection block comprising:

a rectangular housing having two opposite faces formed with internal longitudinal projections that define parallel slideways; and a plurality of flat slabs of elongated cross-section made of insulating material, each of said slabs in one of said slideways, formed with a single row of parallel passages for receiving respective contact terminals and having a major face cut out in a front portion thereof to constitute individual resilient retaining detents for engaging holes in the terminals, said housing and each said slab including mutually cooperating keying means that allow a slab to be fully inserted in one angular position only, wherein: said longitudinal projections are formed throughout the entire depth of the housing so as to guide each said slab from the moment it is inserted in the housing; said detents are placed short of the front end of the respective slab; and said housing has a step formed internally on one of the major sides, sized and located to come into abutment against any one of the detents that is lifted because a terminal in an adjacent one of said slabs is not fully pushed home, thereby limiting bending deformation of the detent.

2. The block according to claim 1, wherein each of said detents has an inwardly directed catch sized to be insertable in a respective one of said holes and wherein each of said detents extends beyond the respective catch so that bending of the detent causes a movement of the end thereof greater than, that of the catch.

3. The block according to claim 1, further comprising an additional abutment step formed on that major face of each said slab which is opposite to that major face in which said detents are cut out whereby each slab protects the adjacent slab against a failure of any one of said detents in said adjacent slab to enter the hole in the respective terminal.

4. The block according to claim 1, wherein each said slab has a plurality of parallel partitions separating said passages and having respective sloping ends and wherein that major face of the slab which is not formed with detents terminates approximately at a distance from the edge of the slab which is two-third of the length thereof for constituting an abutment shoulder for any one of said detents which is lifted.

5. The block according to claim 1, wherein said housing further comprises walls of small length as compared with the overall depth of said housing, constituting an abutment for any one of said detents which is lifted.

6. The block according to claim 1, wherein each of the small faces of each slab has a plurality of resilient locking fingers each having a locking catch cooperating with a respective opening in said housing and straddled by two rigid wings.

7. The block according to claim 1, further comprising an abutment end rim in each said passage, defining an end insertion position of the respective terminal.

8. A connector including two mutually mating electrical connection blocks, each of said blocks comprising a rectangular shaped housing having two opposite faces formed with internal longitudinal projections that define parallel slideways; and a plurality of flat slabs of elongated cross-section made of insulating material, each of said slabs in one of said slideways, formed with a single row of parallel passages for receiving respective contact terminals and having a major face cut out in a front portion thereof to constitute individual resilient retaining detents for engaging holes in the terminals, said housing and each said slab including mutually cooperating keying means that allow a slab to be fully inserted in one angular position only, wherein: said longitudinal projections are formed throughout the entire depth of the housing so as to guide each said slab from the moment it is inserted in the housing, said detents are placed short of the front end of the respective slab; and said housing has a step formed internally on one of the major sides, sized and located to come into abutment against any one of the detents that is lifted because a terminal in an adjacent one of said slabs is not fully pushed home, thereby limiting bending deformation of the detent, the terminals in one of said blocks being male terminals and the terminals in the other of said blocks being cage-type female terminals, and wherein the housing of each of said blocks has lateral walls connected by a bottom wall formed with rows of slots, each row confronting a slideway for one said slab, said slots each having a length which is higher than the spacing between two passages in one said slab.

9. The connector according to claim 8, further comprising indexing means in each said block, said indexing means including, on only one of the small faces of each slab, a groove which is located on one side of the mid-plane of the respective slab on the slabs which receive male terminals and on the other side of the mid-plane for the slabs which receive female terminals, and including, on only one of the inner faces of each housing, in each slideway, a rib having a position with respect to the mid-plane corresponding to that of the respective groove, 10. The connector according to claim 8, wherein each of said terminals has two keying holes placed on two opposed sides of the terminal.

* * * * *